United States Patent [19]

Shoup, II

[11] 4,323,765

[45] Apr. 6, 1982

[54] VERTICAL REVERSIBLE LIFTER PIECE

[75] Inventor: Ransom F. Shoup, II, Quakertown, Pa.

[73] Assignee: Ransom F. Shoup & Co., Inc., Bryn Mawr, Pa.

[21] Appl. No.: 239,465

[22] Filed: Mar. 2, 1981

[51] Int. Cl.[3] ..... G07C 13/00

[52] U.S. Cl. ..... 235/55 A

[58] Field of Search ..... 235/55 R–55 E

[56] References Cited

U.S. PATENT DOCUMENTS

| | | | |
|---|---|---|---|
| 2,054,102 | 9/1936 | Shoup et al. | 235/55 R |
| 2,293,669 | 8/1942 | Shoup | 235/55 R |
| 2,520,740 | 8/1950 | Shoup | 235/55 R |
| 3,436,011 | 4/1969 | Shoup | 235/55 A |
| 3,915,374 | 10/1975 | Shoup | 235/55 C |
| 4,023,009 | 5/1977 | Shoup | 235/55 C |

*Primary Examiner*—L. T. Hix
*Assistant Examiner*—Benjamin R. Fuller
*Attorney, Agent, or Firm*—Woodcock, Washburn, Kurtz, Mackiewicz & Norris

[57] ABSTRACT

A vertical reversible lifter piece is disclosed for use with voting machines having one or more vertical interlock structures. The lifter piece more evenly distributes the tension and weight on pull strap structures used in the voting process. The reversible nature of the lifter piece allows it to be positioned in several orientations relative to the interlock structure.

4 Claims, 4 Drawing Figures

VERTICAL REVERSIBLE LIFTER PIECE

The present invention is an improvement on a voting machine with a vertical interlock structure, the improvement being a reversible lifter piece disposed on the interlock portion of the voting machine. This lifter piece distributes the weight, tension and space of the rollers in relation to the straps in a more equal manner. The lifter piece has the added advantage of preventing the rollers from falling out of the interlock.

BACKGROUND OF THE INVENTION

This invention relates to voting machines and more particularly to a voting machine with a mechanism for equalizing the tension, weight and space distribution of pull straps in a vertical column of an interlock portion of a voting machine.

Examples of mechanical voting machines which may be used with this invention are shown in the Shoup U.S. Pat. Nos. 2,054,102 and 4,023,009. Mechanical voting machines of this type employ vertical voting interlocks as part of a mechanism for allowing voters to select the candidate or candidates of their choice. Interlocks are shown, for example, in Shoup U.S. Pat. No. 2,293,669. The interlock mechanism employs rollers and pull straps as shown in Shoup U.S. Pat. No. 3,915,374. The rollers are movable within a channel structure of the interlock mechanism. To set a machine for voting, a column of rollers are arranged and spacing techniques employed so as to leave a total distance corresponding to the space required for a predetermined number of pull straps to be positioned in a voting position corresponding to the number of candidates to be chosen. When voting takes place a wedge shaped end of the pull strap is moved to occupy the scape by a mechanism described in Shoup U.S. Pat. No. 2,520,740. Since the number of wedge shaped ends able to be moved into position between the rollers is determined by a preset available space individually set for each election, only the correct amount of votes may be registered. A shim or compensator insertable into the interlock mechanism has been described as an improved method for adjusting the available space without the need for dismantling the entire interlock mechanism. (See, for example, Shoup U.S. Pat. No. 3,436,011).

Problems have arisen, however, in situations where there are a large number of candidates. For example, in an election for 40 judges in a large municipality, there may be 100 or more candidates. Similarly, an election may be held where the object is to narrow the field such as voting for 2 out of 20 candidates. While a variety of factors may affect the tension on a pull strap with a corresponding increase in the amount of force needed to activate the pull strap into voting position, it is thought that important factors causing this increase in tension are the thickness of the wedge portion of the pull strap, the number of pull straps in a given column, and the vertical displacement of the pull straps when one or more shims are removed from the interlock structure. The thickness of the wedge shaped portion of the pull strap and the weight of a column of pull straps may make it more difficult to activate pull straps at the lower end of a vertical column into voting position as the field of candidates becomes larger. This may discourage voters from selecting candidates whose names appear at the lower portion of the vertical column.

Various solutions have been tried, including reducing the thickness of the wedge shaped end of the pull strap. This is described in Shoup U.S. Pat. No. 3,915,374. Manipulation of the dimensions of the wedge shaped portion of the strap does not solve all of the problems, however. In a large field it may still be difficult to vote for candidates appearing at the lower end of the vertical column because manipulation of straps at the top of the column and the space distribution of rollers in the interlock itself may cause the straps at the lower end of the column to be displaced as much as 45° from their normally horizontal position. In effect, the free floating nature of the rollers in the channel of the interlock structure allows the column of rollers with the pull straps positioned therebetween to fall downward as shims are removed, thus causing the normally horizontal alignment of pull straps to be bent at an angle. This displacement puts increased weight and tension on pull straps at the lower end of the vertical column used by the voter to select the candidate or candidates of his choice, thereby making it difficult for the voter to turn voting levers connected to the pull strap mechanism and to vote for candidates appearing at the lower end of a column.

SUMMARY AND OBJECTS OF THE INVENTION

In accordance with this invention, a mechanism is provided to give a voting machine improved operability in the event that an election involves a large field of candidates, such as about ten or more persons. Further, the improved mechanism which is in the form of a reversible lifter piece allows greater ease in operation of the lower levers on a voting machine which uses a voting mechanism comprising pull straps positioned in a vertical column interlock where the column interlock is arranged to accommodate a large field of candidates.

It is an object of this invention to provide a mechanism for evenly distributing the tension, weight and distance of the straps in an interlock mechanism.

It is another object to have this mechanism easily field installed and reliable in operation.

It is a further object of this invention to reduce or eliminate any unfairness which heretofore may have occurred when levers at the lower end of a vertical column interlock with a large number of candidates were more difficult to pull in the voting operation than those levers located at the upper part of the interlock.

It is still a further object to provide a lifter piece that is reversible and thus adaptable to a variety of voting machines that have a vertical interlock structure.

DETAILED DESCRIPTION OF A PREFERRED EMBODIMENT

Figure 1:
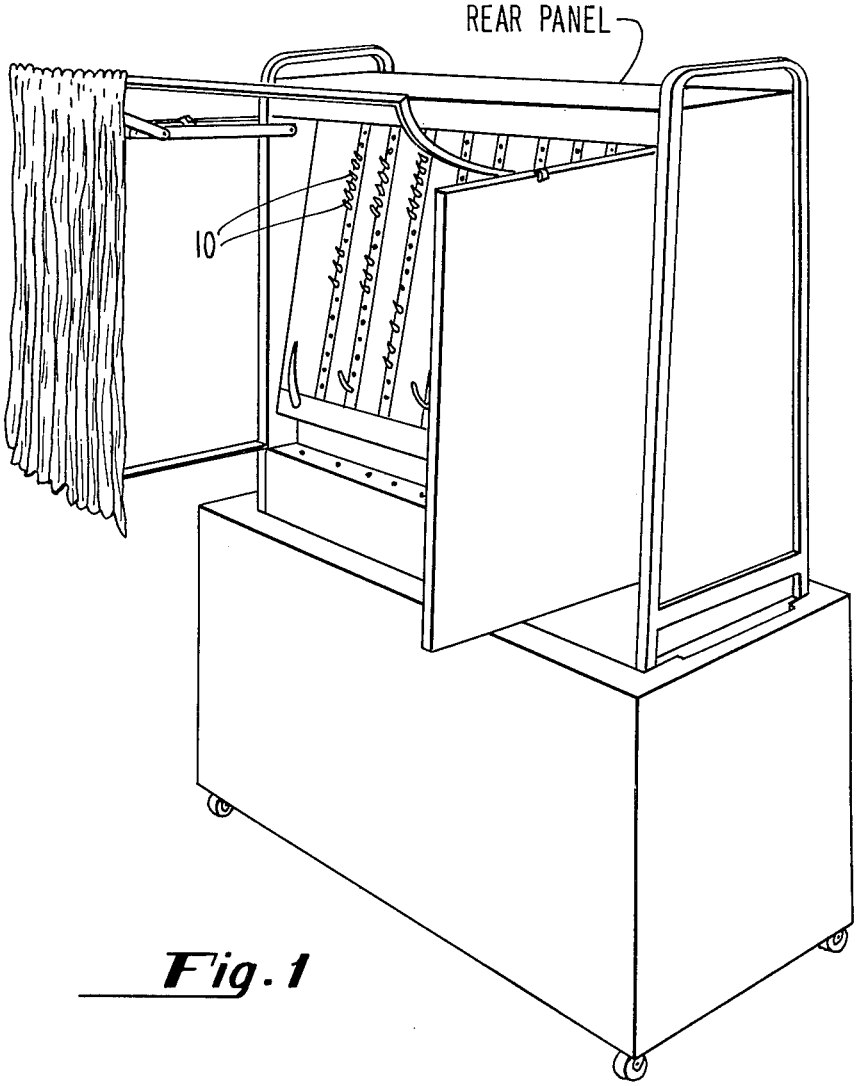
FIG. 1 is a perspective view of a voting machine.

FIG. 1 shows a voting machine with the usual columns of voting levers 10 which a voter rotates to select the candidate of his choice. While in a general election a voter selects one candidate from a field as narrow as two choices, in a primary election a voter may be able to vote for more than one candidate selected from a field as large as 20 or more as a way of narrowing the field of candidates for a subsequent election. For example, a voter may be allowed to vote for four out of forty candidates. Accordingly, interlock spacing including removal of one or more shims from the channel of the interlock must be accomplished in order to accommodate the field of candidates and the number to be chosen, so that activation of the lever and pull strap mechanism correctly registers the votes.

Figure 2:
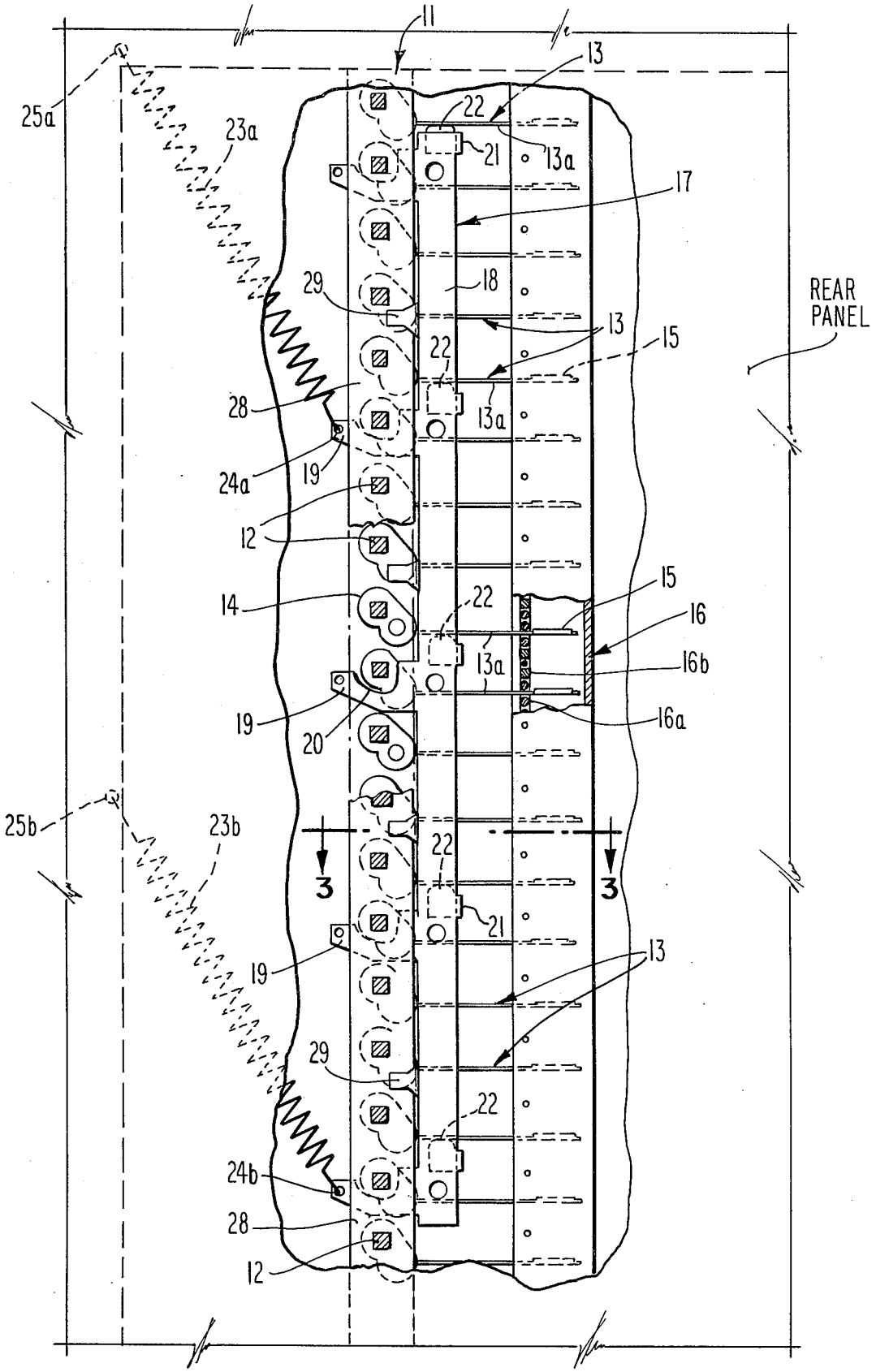
FIG. 2 shows a fragmentary rear view with the back panel broken away.

FIG. 2 shows a column assembly 11 including voting machine spindles 12, pull straps 13 and an interlock structure 16. Each spindle 12 is associated with a voting lever for the selection of a candidate. A single candidate or a number of candidates, may be selected depending on the type of election. A pull strap 13 is connected to each spindle 12 by means of a connecting link 14 and a cam assembly positioned behind the connecting link 14, shown in more detail in FIG. 4. A wedge portion 15 of the pull strap 13 is positioned in an interlock structure 16, shown in more detail in FIG. 4. A reversible lifter piece 17 is positioned on the column assembly 11. The reversible lifter piece 17 is further characterized by a spine 18, a series of main guides 19 located in the same plane as the spine, each guide having an oval recessed portion 20 to allow movement of the spindle 12 during the voting operation. The recessed portion 20 is configured in an oval shape so as to render the lifter piece reversible with respect to mode of positioning, and thus adaptable for use on a variety of voting machines. Extending at about a 90° angle from the spine and into the column assembly 11 are a series of fingers 21 each of which has an enlarged portion 22 formed at about a 90° angle from the rest of the finger structure 21. The enlarged portion 22 of a finger 21 is positioned to support a strap portion **13*a* of the pull strap 13, the positioning being accomplished by placing the lifter piece 17 in the column assembly 11 such that the enlarged portion 22 of a finger is in contact with about every fourth strap portion 13*a* of the pull straps 13 in the column assembly 11. Biasing means such as springs 23*a* and 23*b* hold the lifter piece 17 in intimate contact with structures comprising the column assembly 11, these springs 23*a* and 23*b* may be connected to the lifter piece 17 by means of holes 24*a* and 24*b* formed in the main guides 19. The other end 25*a* and 25*b* of each spring may be attached to the voting machine at a convenient position. One or more upper springs 23*a* is used to regulate the tension on the lifter piece. Regulation is done manually, using the number of springs necessary to give an equalized, easy to operate tension on the voting levers located on the front of the machine. It is these levers which the voter must turn to register a vote. The lower spring 23*b* is used to hold the lifter piece in position. Further positioning of the lifter piece is a aided by the presence of a placement member 29, extending outward from the spine 18 and which fits around a rigid bar structure 28** of the machine shown in this embodiment.

Figure 3:
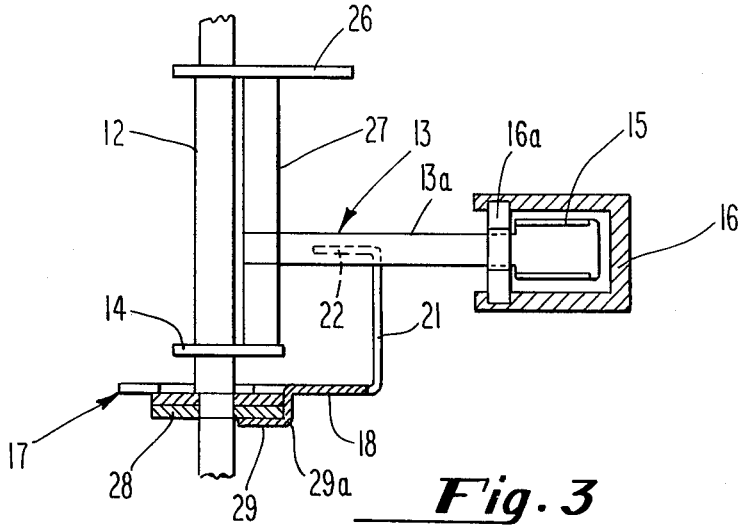
FIG. 3 is a sectional view along line 3—3 of FIG. 2.

FIG. 3 is a sectional view along line 3—3 of FIG. 2. A spindle 12 is shown with the usual cam assembly 26 mounted on the spindle 12 and a connecting link 14 mounted a distance from the cam assembly 26. A pivot shaft 27 is positioned parallel to the spindle 12. Connected to the pivot shaft 27 is a pull strap 13 with a wedge shaped portion 15 that is positioned in the interlock structure 16. The lifter piece 17 may be positioned on a column of spindles with the spine 18 adjacent to the rigid bar structure 28 which forms part of the voting machine structure for purposes of illustrating an embodiment of this invention. One of the fingers 21 of the lifter piece 17 is shown extending outward from the spine at about a 90° angle into the column assembly 11. This finger 21 is further characterized by an enlarged portion 22 that forms about a 90° angle from the finger structure 21 and supports a pull strap 13 along the strap portion **13*a* of the pull strap. At some distance remote from the finger structure is located a placement member 29 positioned on the opposite side of the spine 18 and extending outward from the spine 18 to fix the lifter piece 17 in position by contact with a rigid bar structure 28 shown in this embodiment. This placement member 29 has a rounded shoulder portion 29*a* that causes the body of the placement member to be about parallel to the plane of the spine 18 of the lifter piece 17**.

Figure 4:
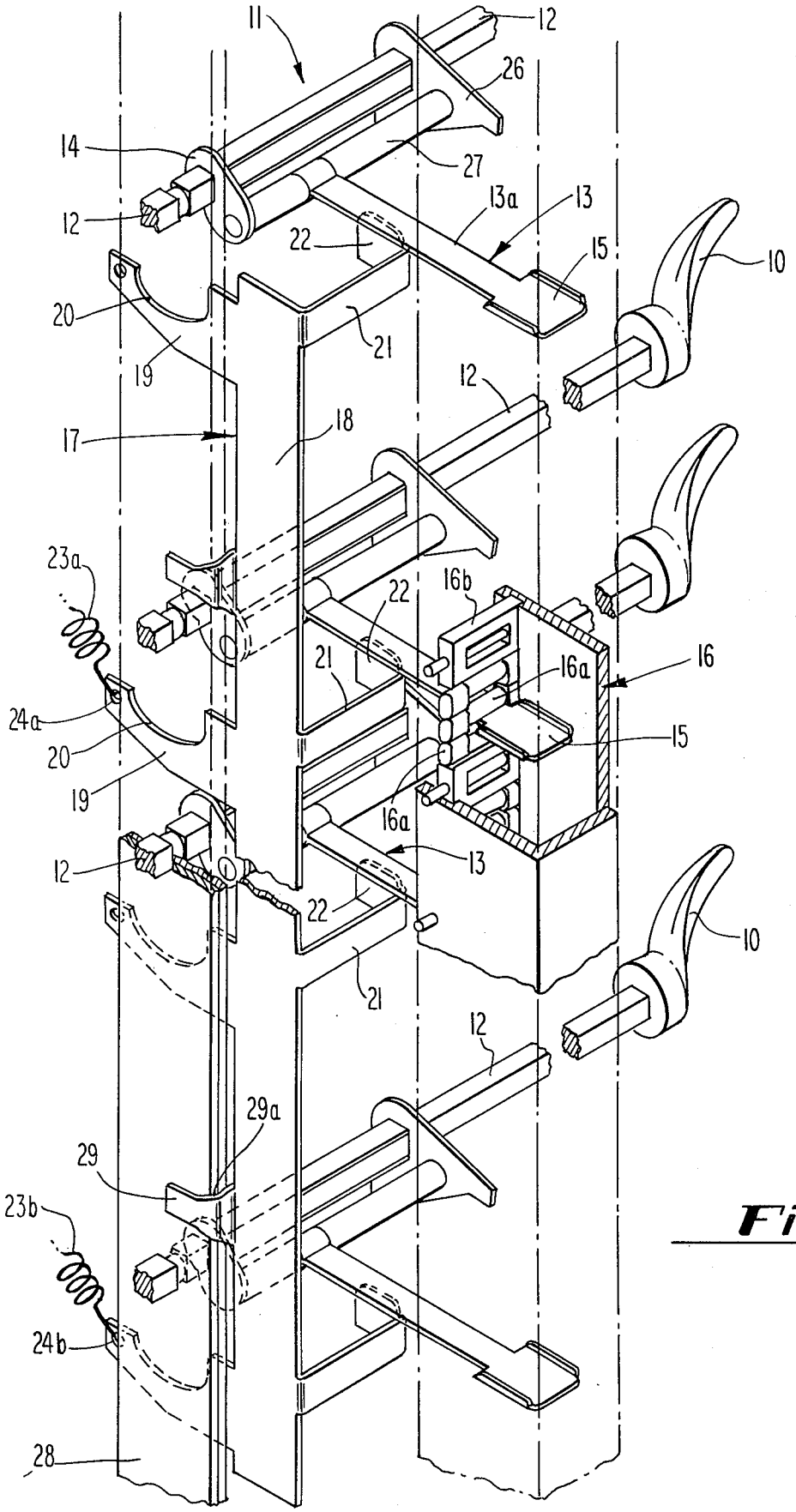
FIG. 4 is an enlarged view of a reversible lifter piece positioned on pull straps with some of the pull straps deleted, and a cutaway view of the interlock mechanism.

FIG. 4 shows a more detailed view of the lifter piece 17 as it fits into the column assembly 11 of the illustrated embodiment. A sampling of the spindles 12 and pull straps 13 are shown to indicate the positioning of the lifter piece 17 so as to perform a support function. In an unvoted position the wedge portion 15 of the pull strap 13 lies to the right of the interlock roller members **16*a*. Upon clockwise rotation of a spindle 12 which occurs during voting by the activation of a voting lever 10, the pull strap 13 is moved to the left, thereby pulling the wedge portion 15 between two interlock roller members 16*a* to occupy a predetermined space. In a primary election a number of pull straps corresponding to the number of candidates in the field are used. Enough shims 16*b* are removed to allow a predetermined number of pull straps 13 to be moved into voting position. For example, in a field of forty candidates where the voter can vote for a total of four persons, enough shims are removed to allow for four wedge shaped portions 15 to be moved into position between the column of roller members 16*a* thus limiting the number of persons for whom the votes may be registered. In any field of candidates the weight on the pull straps and voting lever mechanisms at the lower portion of the interlock structure 16 is increased as the number of candidates is increased. In a primary election the field of candidates may be quite large, such as ten or more, with a corresponding increase in the effort needed to activate the voting lever mechanisms at the lower end of the interlock structure 16. This problem is further exacerbated by the removal of one or more shims 16*b* to allow for positioning of the wedge portions 15 of the pull strap 13. The removal of shims 16*b* from the column of roller members 16*a* may result in displacement of the pull straps 13 from their normally horizontal position. The amount of displacement varies with the number of pull straps 13 in a particular column assembly 11, and the number of shims 16*b* removed from the interlock structure 16. Such displacement or distortion of the pull straps 13 creates more tension on the voting levers 10, located at the lower end of the column assembly 11. Displacement from the horizontal may be in an amount as great as 45°, and results in the levers 10 at the lower end of the column assembly being harder to move into voting position than those levers at the top of the assembly. The resulting unfairness to those candidates whose levers are difficult to activate is apparent. This tension problem is reduced or eliminated by the reversible lifter piece 17 that is shown in one embodiment in FIGS. 3 and 4**.

In the embodiment shown in FIG. 4 the lifter piece 17 is shown in an installed position with its spine 18 flush against the rigid bar structure 28. The fingers 21 are shown with the enlarged portions 22 of the fingers 21 supporting a number of pull straps 13 from under the strap portion 13*a*. In this way, the fingers 21, which are horizontally aligned at about 90° to the pull straps 13 at spaced intervals, contact and support a predetermined number of pull straps at spaced intervals by means of an enlarged portion 22 of a finger 21. A series of main guides 19 each have an oval recessed portion 20 which is contoured to allow traveling by the spindle 12. This contour is formed to allow for reversibility of the lifter piece 17 and also to allow for positioning of the lifter piece in a reversed position on another voting machine such as the one shown in Shoup U.S. Pat. No. 4,023,009 as an alternate embodiment. Biasing means such as springs 23*a* and 23*b* are attached to the main guides 19 by means of holes 24*a* and 24*b*. In the embodiment shown in FIGS. 3 and 4 the positioning of a placement member 29 with its shoulder portion 29*a* can be seen in some detail. In this embodiment, the use of placement members 29 in intimate contact with a rigid bar structure 28 aids in fixing the lifter piece 17 in position.

The embodiment shown in FIGS. 3 and 4 show the reversible lifter piece positioned on a voting machine in which there are a series of column assemblies containing interlock structures and pull straps of uniform length. In an alternate embodiment this reversible lifter piece can be positioned in a reversed position on a voting machine that has only one interlock structure and pull straps of varying length. This type of voting machine may be seen, for example, in U.S. Pat. No. 4,023,009. The contoured portion of each main guide allows for this reversibility and adaptability for use on various types of vertical column voting machines.

While particular embodiments of this invention have been shown and described, it will be appreciated that modifications are within the true spirit and scope of the invention. The appended claims are intended to cover such modifications.

What is claimed is:

1. In a voting machine of the type which includes vertical columns of voting spindles, at least one interlock, each interlock having roller members retained in a channel of said interlock, a cam assembly on each spindle, each of said spindles connected to a pull strap for engaging said interlock, each of said pull straps having a wedge portion on one end, said wedge portion disposed between two of said roller members of said interlock, and shims selectively positioned in the channel of said interlock so that only a prescribed number of said wedge portions of said pull straps can be pulled between said roller members of said interlock, whereby only said preselected number of said pull straps can be activated into voting position, the improvement comprising:

A reversible lifter piece having a spine portion vertically disposed on said interlock, said lifter piece having a plurality of main guides, each of said main guides having a recessed portion contoured in a predetermined shape to accommodate movement of said spindle during voting, and a plurality of fingers extending at about a 90° angle from said spine portion of said lifter piece, each of said fingers supporting pull straps at spaced intervals along each column assembly.

2. The voting machine as recited in claim 1 wherein said reversible lifter piece further comprises a plurality of placement members positioned at spaced intervals along said spine and extending outwardly from said spine, said placement members having preshaped portions for positioning on said interlock structure.

3. The voting machine as recited in claim 1 wherein said reversible lifter piece further comprises a plurality of biasing means, each of said biasing means having at least one point of attachment on said reversible lifter piece.

4. The voting machine as recited in claim 3 wherein said biasing means is a spring.

* * * * *

UNITED STATES PATENT AND TRADEMARK OFFICE

CERTIFICATE OF CORRECTION

PATENT NO. : 4,323,765

DATED : April 6, 1982

INVENTOR(S) : Ransom F. Shoup II

It is certified that error appears in the above-identified patent and that said Letters Patent are hereby corrected as shown below:

In the Specification, column 1, line 37, delete "scape" and substitute therefor --space--.

Signed and Sealed this

*Third* Day of *August 1982*

[SEAL]

*Attest:*

GERALD J. MOSSINGHOFF

*Attesting Officer*

*Commissioner of Patents and Trademarks*